United States Patent [19]

Smashey et al.

[11] 4,044,815

[45] Aug. 30, 1977

[54] PRECISION INVESTMENT CASTING MOLD, PATTERN ASSEMBLY AND METHOD

[75] Inventors: Russell W. Smashey; Dwight O. Bartell, both of Albuquerque, N. Mex.

[73] Assignee: General Electric Company, Cincinnati, Ohio

[21] Appl. No.: 737,620

[22] Filed: Nov. 1, 1976

[51] Int. Cl.[2] ..... B22C 7/02

[52] U.S. Cl. ..... 164/35; 164/41; 164/45; 164/244; 164/249; 164/337; 164/349; 164/411

[58] Field of Search ..... 164/15, 19, 20, 35, 164/45, 133, 235, 236, 244, 249, 337, 349, 359, 360, 411, 41, 34, 36

[56] References Cited

U.S. PATENT DOCUMENTS

| | | | |
|---|---|---|---|
| 368,311 | 8/1887 | Thomas | 164/244 |
| 1,244,257 | 10/1917 | Sweetnam | 164/35 |
| 1,894,151 | 1/1933 | Bell | 164/244 |
| 2,500,246 | 3/1950 | Fiorella | 164/411 |
| 3,435,878 | 4/1969 | Howard et al. | 164/51 |
| 3,835,913 | 9/1974 | Vandemark et al. | 164/249 X |

*Primary Examiner*—Ronald J. Shore

*Attorney, Agent, or Firm*—Lee H. Sachs; Derek P. Lawrence

[57] ABSTRACT

A precision investment casting ceramic mold of the self-casting type is made as a unitary mold by providing separately a pattern for a wax charge-holding assembly and a pattern for a wax article casting assembly, each including an alignment portion. The two patterns are secured together at the alignment portions and are supported and located one with respect to the other by a plurality of supporting and locating members. The assembled patterns then are used in the conventional manner to make a ceramic casting mold.

9 Claims, 3 Drawing Figures

PRECISION INVESTMENT CASTING MOLD, PATTERN ASSEMBLY AND METHOD

BACKGROUND OF THE INVENTION

This invention relates to precision casting, and, more particularly, to an improved method for making a unitary precision investment casting mold.

One form of an investment casting mold which is generally used to make relatively small metal castings is the type which includes as part of the mold a charge-holding and melting chamber in an upper portion of the mold. Such a chamber is in communication with lower portions of the mold which include a cavity in which the metal article is to be produced. As a part of the well-known precision investment casting process, a metallic charge is placed in solid form within the charge-holding and melting chamber. Then the solid charge is melted and the molten metal drops into the lower portions of the mold. This eliminates the need for including separate molten metal pouring apparatus which can be costly and require substantially larger apparatus when the precision investment casting process is conducted in a vacuum.

One form of this general type of method and mold is described in U.S. Pat. No. 3,435,878 — Howard et al., patented Apr. 1, 1969. As is shown in that reference, it is sometimes desirable to withhold deposition of the molten metal in the charge-holding chamber, for example to provide for complete melting and homogenization of the charge. This can be accomplished by the introduction between the charge and the lower portion of the mold of a metal plug or slug which melts at a temperature higher than that of the principal charge.

In order to provide such fusible plug between the charge-holding chamber or crucible and the lower portion of the mold, some molds have been made with separate crucibles, for example as shown in FIGS. 4, 5, 6 and 7 of the above-described Howard et al. patent. In such cases of non-unitary molds, the plug is either placed between the two portions or is embedded in the ceramic of the mold. In the unitary molds shown in FIGS. 8 and 9 of that patent, the plug is placed between two wax portions from which the mold is made.

SUMMARY OF THE INVENTION

It is a principal object of the present invention to provide an improved method for making a unitary precision investment casting mold of the self-casting type to enable placement of a fusible plug into the mold after the mold has been made and prior to introduction of the principal charge.

It is another object of the present invention to provide such an improved method which allows the making of a relatively thin shell mold through the use of locating and support members.

It is a further object of the present invention to provide an improved precision investment casting mold of the self-casting type in which the charge-holding chamber is strengthened and supported by a plurality of refractory support and locating members.

It is still another object of the present invention to provide an improved composite wax pattern assembly from which such a precision investment casting mold can be made.

These and other objects and advantages will be more fully understood from the following detailed description, the drawings and the examples, all of which are intended to be typical of rather than in any way limiting on the scope of the present invention.

One form of the present invention includes providing separately a wax charge-holding assembly pattern and a wax article casting assembly pattern each of which includes an alignment portion at which the patterns are secured. The wax charge-holding assembly includes a charge cup pattern from the bottom of which projects a fusible plug cup pattern including an alignment portion. Also included are a plurality of refractory support and locating members which are connected between the charge-holding assembly and the article casting assembly, generally about the plug cup pattern. The wax article casting assembly pattern includes an article portion and a second alignment portion which cooperates with the alignment portion of the fusible plug cup pattern. The two patterns are secured together at the alignment portions and through the support and locating members to provide a composite wax pattern from which is made an improved, strengthened, unitary ceramic precision investment casting mold. The resulting mold includes the plug cup as well as a plurality of support and locating members embedded in the mold ceramic between the charge-holding chamber and the article casting chamber.

DESCRIPTION OF THE PREFERRED EMBODIMENT

During the manufacture of the wax patterns from which precision investment casting molds are made, the wax article shape generally is produced by injection molding a selected wax into an accurate die. Then, to this wax article, there can be added various wax portions such as gates, risers, a pour cup, etc. However, in the manufacture of a wax pattern for a self-casting type mold including a plug cup, it has been recognized that it is impractical and very difficult to injection mold the size pour cup required for the article shape because of such problems as wax shrinkage and cavitation. Therefore, wax patterns for the loading cup, the plug cup and the article portion generally are made separately and then are secured together with wax alone in a fashion widely used in the making of wax patterns.

It has been recognized, however, that the mechanical strength of the wax, which term is meant to include similar materials useful as a mold pattern, is insufficient to support a wax loading cup through a wax plug cup on the wax article pattern. According to the present invention, a plurality of refractory support and locating members, such as of ceramic, are disposed between the wax article casting pattern and the wax charge-holding pattern, about the wax plug cup pattern, for use in supporting the charge-holding pattern from the article casting pattern and for locating the charge-holding wax pattern in respect to the article casting pattern.

Figure 1:
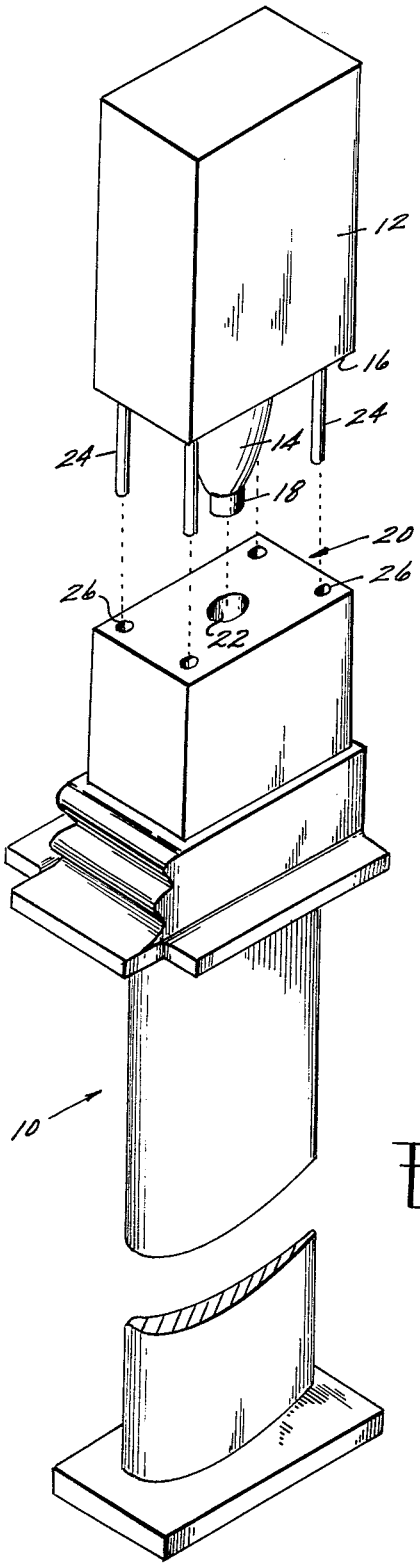
FIG. 1 is a perspective, exploded view of a composite wax pattern for a turbine engine blade.

The present invention will be more clearly understood with reference to the drawing in which FIG. 1 is a perspective, exploded view of a composite wax pattern for use in manufacturing a precision investment casting ceramic mold for a gas turbine engine blade. In FIG. 1, the wax article pattern shown generally at 10 generally is injection molded as one piece of the composite wax pattern, although it can be made from several pieces fused together.

A wax charge cup pattern 12, which can be a substantially rectangular wax block, is another piece of the composite pattern of the present invention. A wax plug cup pattern 14 is produced as a third element of the composite pattern. When assembled with the charge cup pattern 12, it is connected to and projects from the bottom portion 16 to define, with the charge cup pattern, a wax charge-holding assembly. Included in the plug cup pattern is a first alignment portion 18 which, as shown in FIG. 1, can be a cylindrical member projecting from the plug cup pattern. Article pattern 10 includes a top portion 20 in which is provided a second alignment portion 22. Together, article pattern 10 and top portion 20 comprises the article casting assembly pattern which can be made in a single piece or multiple pieces.

In FIG. 1, alignment portion 22 is shown as a cavity which cooperates in shape and position with first alignment portion 18 of the plug cup pattern 14. However, it will be recognized by those skilled in the art that the first and second alignment portions can be provided in a variety of ways. For example, projections and cavities of various sizes and shapes can be provided in either the plug cup pattern or the top portion of the article pattern in order to bring into registry, at a selected location, the plug cup pattern and the top portion of the article pattern.

As was mentioned above, the size and weight of a wax charge cup pattern, which is necessary for the manufacture of a self-casting mold to produce an article from the article pattern, is of a size and weight too great to be supported by the plug cup pattern alone when it is in registry with the top of the article pattern. Therefore, according to the present invention, there are provided a plurality of refractory support and locating members 24, shown in the drawing as rods or pins such as of a ceramic, for example alumina. Because such members are refractory, rather than wax, they become part of the ceramic mold made from the composite wax pattern. In this way, members 24 provide strengthening not only for the wax charge cup pattern during manufacture of the ceramic mold, but also for the ceramic mold itself after firing. As shown in the embodiment of the drawing, the support and locating members 24 are connected to and project from the bottom portion 16 of the charge cup pattern 12. Members 24 are disposed outwardly from and generally about the plug cup pattern 14 to provide more uniform support and more accurate location. Thus, in such an embodiment, there is provided a wax charge-holding assembly which includes members 24.

In the embodiment of FIG. 1, there are provided in top portion 20 of the article pattern a plurality of holes 26 shaped, sized and positioned to cooperate with members 24 in bringing into registry, in the proper location, the first and second alignment portions 18 and 22, respectively. Although this embodiment is shown in FIG. 1, it will be recognized, for example in connection with the embodiment of FIG. 2, that such holes 26 need not be provided and that some or all of members 24 can be attached to an outer surface of the article pattern adjacent its top portion.

According to one form of the method of the present invention, there are provided separately the charge cup pattern, the plug cup pattern, the article pattern and the support and locating members. Such members and patterns are secured into a composite wax pattern by attaching the plug cup pattern to the charge cup pattern to provide a charge-holding assembly pattern, securing the support and locating members between the bottom portion of the charge cup pattern and an article casting pattern which can, if desired, be an assembly of sub-patterns. The two assembly patterns are secured through the above-described first and second alignment portions as well as the support and locating members. Such a composite wax pattern can then be used in the well-known and widely practiced method of making a mold for precision investment casting by dipping the wax pattern into a series of cramic slurries, with appropriate intermediate drying to provide a ceramic coating, after which the wax pattern is removed such as by melting and evaporation and the ceramic is fired to create the mold.

Because the composite wax pattern associated with the present invention is made from a plurality of assemblies, and is strengthened and supported by the plurality of support and locating members, the charge cup pattern can be raised a desired distance above the article pattern. This is useful, for example, to provide a greater gravitational force to the molten metal in the ceramic mold's charge cup when such metal drops into the article portion of the mold upon melting of the fusible plug intended to be positioned in the plug cup. One such arrangement is shown in FIG. 2 which is a perspective, exploded view of a composite wax pattern for a turbine vane.

Figure 2:
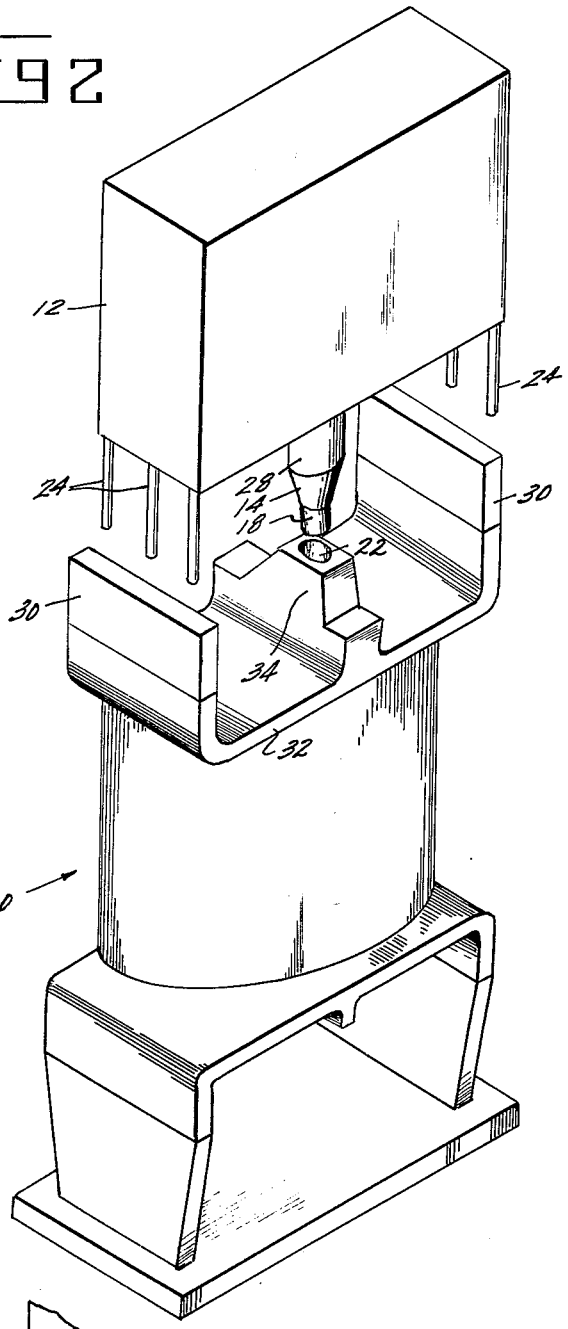
FIG. 2 is a perspective, exploded view of a composite wax pattern for a turbine engine vane.
Figure 3:
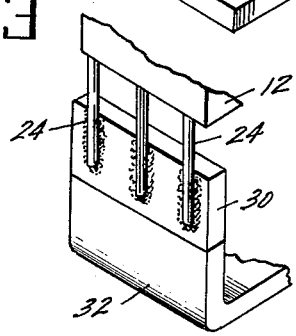
FIG. 3 is a fragmentary, enlarged view of a portion of FIG. 2.

In FIG. 2, a first wax extender 28 is connected between charge cup pattern 12 and plug cup pattern 14. In addition, second extenders 30 are provided on the article pattern 10 above the wax shroud pattern 32 to receive the refractory support and locating members 24. As shown in the fragmentary perspective view of FIG. 3, which is an enlarged view of some of the members 24 and one extender 30 of FIG. 2, it should be noted that the support and locating members 24 are attached to the side of extender 30, such as with wax, rather than placed within holes or cavities in the extender. Thus, it can be recognized that the attachment of refractory support and locating members between the charge cup pattern 12 and the top portion of the article pattern or extensions thereof can be made in a variety of ways, internally or externally or combinations thereof, the object being to secure together the various components of the composite wax pattern and to support the charge cup pattern from the balance of the wax assembly. In respect to the arrangement in FIG. 2, first alignment portion 18 of plug cup 14 cooperates with second alignment portion 22 of the article pattern through rib 34 which is a part of the vane shroud pattern rather than an expendable part of the article casting pattern.

Although the embodiments of the drawing show the plug cup pattern to be positioned substantially uniformly in respect to the top portion of the article pattern, it has been found that such location can be varied in respect to the article pattern. For example, it is sometimes advantageous to locate the plug cup pattern with respect to the article casting assembly pattern toward the area of the article pattern which is more difficult to fill during casting of the molten metal. In this way, the present invention facilitates overcoming such problems as non-fill of the ceramic mold by a judicious positioning of the plug cup and the port through which molten metal flows from the charge cup through the plug cup into the article casting portion of the mold.

Thus, through the method of the present invention there is provided an improved composite wax pattern which can be used, for example by being supported from the top of the charge cup pattern, in the making of an improved, strengthened unitary precision investment casting ceramic mold of the self-casting type. It will be readily recognized by those skilled in the art that, from the typical embodiments and representations presented, there are a variety of modifications and variations of which the present invention is capable.

We claim:

1. In a method for making a precision investment casting ceramic mold of the self-casting type, in which method a ceramic slurry is deposited on a wax pattern, the slurry is dried to provide a ceramic coating, the wax pattern is removed and then the ceramic is fired to create the mold, the improvement for making a unitary mold comprising the steps of:

providing separately a wax charge-holding assembly pattern and a wax article casting assembly pattern, the wax charge-holding assembly pattern including:

i. a wax charge cup pattern having a bottom portion; and ii. a wax plug cup pattern projecting from the bottom portion, and including a first alignment portion;

the wax article casting assembly pattern including:

i. an article pattern including a top portion; and ii. a second alignment portion in the top portion shaped to cooperate with the first alignment portion of the plug cup pattern to align and maintain in spaced apart relationship the article casting assembly pattern and the charge-holding assembly pattern;

providing a plurality of refractory support and locating members;

securing together the charge-holding assembly pattern and the article casting assembly pattern to provide a composite wax pattern:

i. at the first and second alignment portions; and ii. through the support and locating members by connecting the members between the charge-holding assembly pattern and the article casting assembly pattern, the members being disposed generally about the plug cup pattern; and then making a reinforced unitary ceramic precision investment casting mold from the composite wax pattern.

2. The method of claim 1 in which:

the first alignment portion is a projection from the plug cup pattern;

the refractory support and locating members are first connected to and project from the charge cup pattern, the members being of a ceramic material and disposed outwardly from and generally about the plug cup pattern; and the second alignment portion is a recess in the casting assembly pattern.

3. The method of claim 2 in which the support and locating members are alumina rods.

4. A wax, composite, precision casting shell mold pattern comprising:

a wax charge-holding assembly pattern including:

i. a wax charge cup pattern having a bottom portion; and ii. a wax plug cup pattern projecting from the bottom portion and including a first alignment portion;

a wax article casting assembly pattern including:

i. an article pattern; and ii. a second alignment portion shaped to cooperate with and secured to the first alignment portion of the plug cup pattern to align and to maintain in spaced apart relationship the article casting assembly pattern and the charge-holding assembly pattern; and a plurality of refractory support and locating members connected to and projecting between the charge cup pattern and the article pattern, the members being disposed generally about the plug cup pattern.

5. The pattern of claim 4 in which:

the first alignment portion is a projection from the plug cup pattern;

the second alignment portion is a recess in the casting assembly pattern; and the support and locating members are of a ceramic material.

6. The pattern of claim 5 in which the support and locating members are alumina rods.

7. An improved precision investment casting ceramic mold of the self-casting type comprising:

a charge cup;

an article casting portion in spaced apart relationship with the charge cup;

a plug cup connecting the charge cup with the article casting portion; and a plurality of refractory support and locating members disposed about the plug cup and connected to both the charge cup and the article casting portion of the mold.

8. The mold of claim 7 in which the support and locating members are of a ceramic material.

9. The mold of claim 8 in which the support and locating members are alumina rods.

* * * * *